United States Patent [19]

Garland

[11] 4,222,867

[45] Sep. 16, 1980

[54] COAL CLEANER

[75] Inventor: Theodore F. Garland, Apache Junction, Ariz.

[73] Assignee: Garland Manufacturing Co., Ironton, Minn.

[21] Appl. No.: 14,344

[22] Filed: Feb. 23, 1979

[51] Int. Cl.[2] ..... B03B 5/18

[52] U.S. Cl. ..... 209/427; 209/493; 209/500

[58] Field of Search ..... 209/13, 44, 423–424, 209/493, 487, 490, 492, 312, 318, 321, 497, 498, 500, 18, 425–427; 210/400, 406, 416

[56] References Cited

U.S. PATENT DOCUMENTS

| | | | |
|---|---|---|---|
| 269,563 | 12/1882 | Davis | 209/500 |
| 1,509,266 | 8/1924 | Spearman | 209/493 |
| 3,411,627 | 11/1968 | Garland | 209/427 |

FOREIGN PATENT DOCUMENTS

| | | | |
|---|---|---|---|
| 622179 | 6/1961 | Canada | 209/423 |

*Primary Examiner*—Ralph J. Hill

*Attorney, Agent, or Firm*—Williamson, Bains, Moore & Hansen

[57] ABSTRACT

An apparatus for cleaning coal of extraneous matter such as gravel and the like includes a stratifying and classifying oscillating screen submerged in a liquid confining tank wherein stratification is produced by motion of the oscillating screen. The screen bottom slopes downwardly and water flow is induced from either end of the screen to aid in the stratification. The coal which rises to the top is removed by several skimmers powered by a vacuum controlled materials handling pump.

3 Claims, 2 Drawing Figures

COAL CLEANER

BACKGROUND OF THE INVENTION

Typically, submerged gravity type separators have been used for cleaning gravel and the like. Typical of such devices is my U.S. Pat. No. 3,411,627. In such devices, the material to be cleaned is lighter than the material from which it is to be separated. Thus, such devices are concerned with recovering the bottom layer which is produced in the stratification process.

In recent years, with the resurgence in popularity of coal as a fuel, it has also been necessary to provide the coal in a reasonably clean state due to various environmental and economic factors. It is therefore an object of this invention to provide a device which is capable of removing the undesirable materials from the raw coal and which is capable of handling the large volume of material from the top layer to stratification. Of the two layers which result from the stratification, the previous devices have been concerned with cleaning and removing the bottom layer. The instant invention on the other hand cleans the top layer.

SUMMARY OF THE INVENTION

In the instant invention, a water tank is provided which contains a majority of the apparatus. Located in the tank is an elongated basket formed of screen like material. The basket slopes downwardly from its inlet end towards its discharge end and the basket is provided with a mechanism imparting an oscillating motion thereto in order to effect the stratification process. As the basket is oscillated and the mixture to be cleaned is fed to the inlet end, the coal rises to the top and approaches the discharge end where it is skimmed off the top by a group of eight skimmers arranged in two rows of four each. Waterjet manifolds are provided at both discharge and inlet ends of the basket and are both directed toward the skimming mechanism and serve to carry the lighter material (coal) in the direction of the skimmers. The discharge endjet is especially helpful in preventing coal from being discharged from the basket. The heavier material removed is carried downwardly by gravity and out the discharge end of the basket whereupon it falls to the bottom of the tank. There it is carried up and out of the tank by a slow moving drag apparatus which consists of paddles attached to chains, belts, or the like. The basket extends upwardly at least to the water level so as to prevent the light weight coal from floating out of the basket area. The skimmers are attached to a materials handling pump which works in conjunction with a vacuum speed control which assures that a proper suction volume will be maintained at all times so as to prevent clogging and stalling.

These and other objects and advantages of this invention will more fully appear from the following description made in connection with the accompanying drawings, wherein like reference character refer to the same or similar parts throughout the several views.

DESCRIPTION OF THE PREFERRED EMBODIMENT

Figures 1, 2:
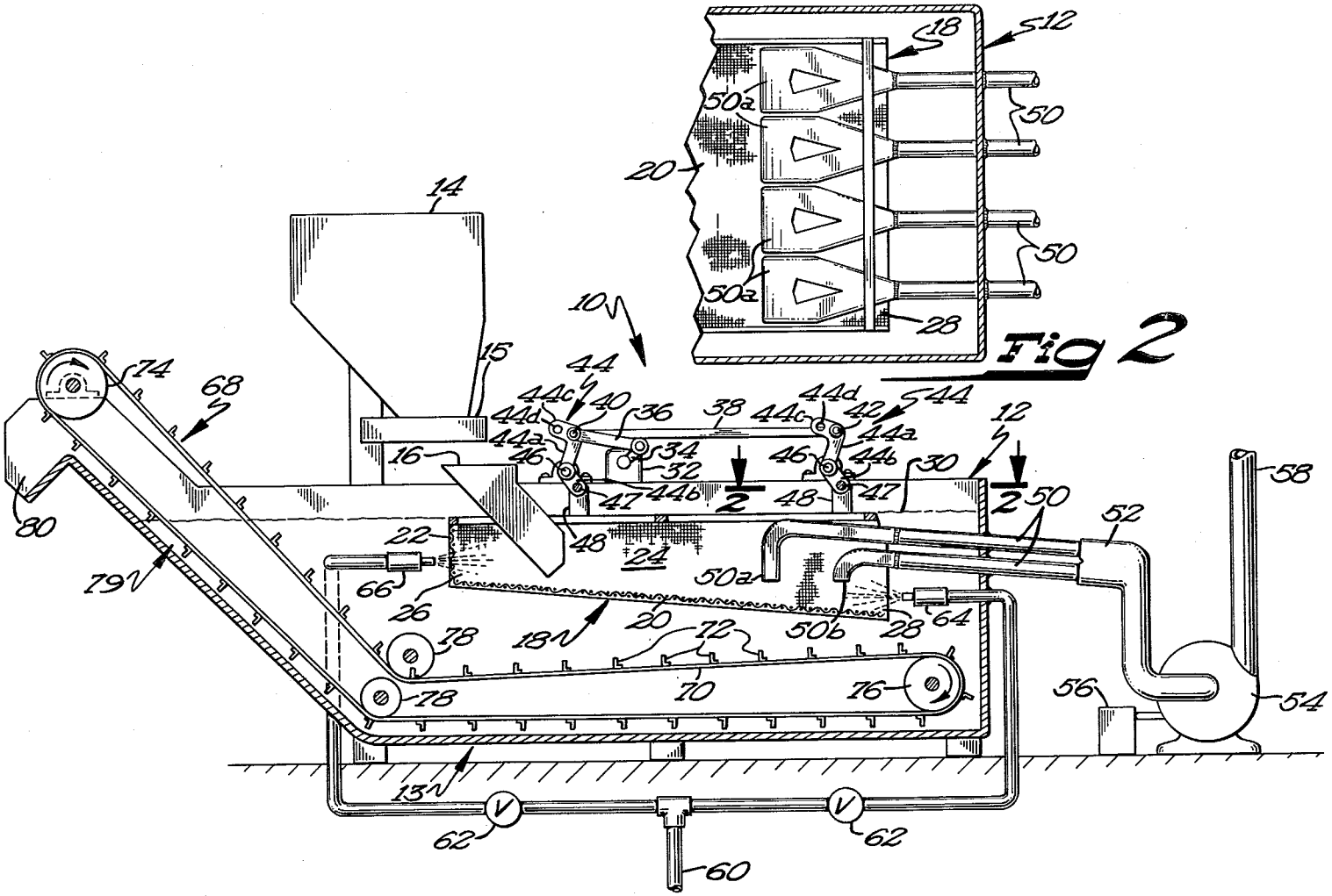
FIG. 1 is a cross section of the device.
FIG. 2 is a sectional view taken along lines 2—2 of FIG. 1.

Referring now to FIG. 1, the coal cleaning device is indicated in general by the numeral 10. The main portion of the device is located inside a liquid confining tank 12. Located over the tank, is feed hopper 14 having feed chute 16 which extends downwardly into tank 12. A metering device 15 may be provided between hopper 14 and chute 16. Such devices are well-known and do not form part of this invention. Located within the liquid tank 12 is the agitation basket 18. Basket 18 is formed from walls of a screen-like material and the box is comprised of side walls 24, end wall 22 and bottom 20. End wall 22 is located at inlet end 26. Opposite inlet end 26 is discharge end 28 which has no end wall located thereat. Thus, material is free to move out of the box at discharge end 28. The bottom wall 20 of box 18 is inclined downwardly at a slope of approximately five degrees. Basket 18 is located within the tank so that sidewalls 24 and end wall 22 extend to or slightly above the surface 30 of the water in tank 12.

The separation basket 18 is oscillated in a combined vertical and horizontal movement by the drive mechanism mounted on the liquid confining tank 12. The drive includes a motor 32 mounted on the liquid confining tank 12. A motor drive arm 34 is pivotably attached to the outlet shaft on motor 32 and at its other end to connecting link 36.

Connecting link 36 is attached to its other end to wrist pin 40. Connecting rod 38 has attached at one end to wrist pin 40 and its other end swivel joint 42. Connecting rod 38 serves to connect and cause equivalent motion between the two rocker arms 44. Rocker arms 44 are formed in a dogleg shape and consist of upper portions 44A and lower portions 44B. Rocker arms 44 attached to the top of tank 12 at pivot point 46. Upper portion 44A of one rocker arm is affixed at wrist pin 40 while upper portion 44A of the other actuator is affixed at swivel joint 42. Lower portions 44B are affixed at swivel joint 47 to brackets 48 which are mounted at either end of the framework of separation basket 18. The geometry of the various portions of the mechanism is such that a simple rotary motion of drive motor 32 is converted into an oscillation which combines both horizontal and vertical components which are imparted to separation basket 18. Such oscillation causes stratification effects as noted previously. An extension 44C therein through which wrist pin 40 may be inserted as an alternative to the configuration shown in FIG. 1, which will yield a maximum vertical stroke and therefore greater turbulence. Such turbulence is desirable in the processing of larger sizes of coal and other high specific gravity materials. On the other hand, with lighter materials, less vertical stroke is needed so wrist pin 40 should be placed in hole 44D.

A source of presurized water 60 leads to outlet and inlet water jet manifolds 64 and 66, respectively. Valves 62 are interposed in the lines to regulate the pressure running to these manifolds. The manifolds are positioned just outside the respective ends of separation basket 18 and a short distance above the bottom 20 thereof. Manifolds 64 and 66 extend the full width of the tank and serve to impart a jet of water in the direction of the skimming apparatus 50. While in the stratification process, the heavier fractions of material will tend to be drawn downward by gravity along sloping bottom 20, the lighter coal may tend to stay suspended and it is necessary to impart currents to the fluid in order to assist in carrying the coal toward skimmer 50. In particular, a fairly large amount of material may find its way past the skimmers and thus it is necessary to use an outlet end pressure jet 64 to carry those particles back to the skimmers 50. Skimmers 50 are shown and comprise generally eight skimmers arranged in two rows of four each. Inlet end skimmers 50A are located somewhat toward the inlet end 26 of basket 18 and consist of four manifolds arranged collinearly and which each extend approximately one quarter the width of the basket such that the combination is able to skim the entire width of the basket 18. Outlet end skimmers 50B are also four quarter-width skimmers which are arranged closer to discharge end 28 and which further serve to pick-up that not skimmed by the first set 50A. Skimmers 50 are connected to collector manifold 52 which is in turn connected to a material handling type pump 54. Pump 54 is controlled by a mechanism 56 which senses the vacuum in skimmers 50 and adjusts the motor speed accordingly in order to prevent clogging and stalling. It is extremely important to maintain a proper flow rate through skimmers 50 in order for ideal operation to take place. Outlet pipe 58 is connected to the outlet of pump 54 and leads to a de-watering facility of any conventional type. The provision of eight separate skimmers in the arrangement disclosed is highly efficient and will yield the most trouble-free operation. Such a design allows the vacuum pulled by pump or pumps 54 to be applied more evenly over a larger area which in turn yields a smoother and more efficient flowing skimming action.

Various undesirous materials will continue down screen bottom 20 and be discharged from discharge 28 of basket 18 whereupon it will fall to the bottom of tank 12. Located on the bottom of tank 12 is a slow moving drag mechanism 68 which moves unwanted materials from the tank. Drag mechanism 68 comprises a plurality of paddles 72 mounted on belts or chain 70 which move about pulleys or sprockets 74, 76 and 78. Materials are then dragged along the bottom of the tank 13 up inclined surface 79 and out discharge chute 80. The direction of rotation of the drag mechanism is shown by the arrows in the drawing figure.

While the preferred embodiments of the present invention have been described, it would be understood that various changes, adaptations, and modifications may be made therein without departing from the spirit of the invention and the scope of the appended claims.

What is claimed is:

1. Apparatus for cleaning particulate material such as coal and the like, said apparatus comprising:

feed means for supplying particulate material in predetermined amounts;

a liquid confining tank;

a gravity type separator having first and second ends comprising a generally horizontally oriented perforate stratifying and classifying structure shiftably mounted in said liquid confining tank below and extending upwardly to the liquid level therein, said perforate structure first end receiving particulate material from said feed means for cleaning material which is mixed with other material having generally higher specific gravities, the bottom of said stratifying structure sloping downwardly from said first end to said second end;

oscillator means connected to said stratifying structure for oscillating the same and causing mixed material thereon to move from the inlet to the outlet thereof whereby lighter materials such as coal rise above the layer of heavier materials, and whereby the heavier material is discharged over the second end of the stratifying structure;

means for removing said heavier material from said tank;

a mechanism for removing lighter material comprising a plurality of skimming means, said plurality being located intermediate of said first and second ends and being located above and adjacent said second end of said stratifying structure, said skimming means being arrayed in two rows transversely to said separator said first row being closer to said second end than to said first end, the second of said rows being closer to said second end than said first row, each of said rows comprising at least three skimming means located colinearly with respect to each other, the combined length of said skimming means extending substantially the width of said separator;

means located adjacent said first end for inducing fluid flow from said first end towards said second end; and means located adjacent said second end for inducing fluid flow from said second end towards said skimming means and said first end.

2. The apparatus of claim 1 wherein said slope is approximately 5 degrees.

3. The apparatus of claims 1 wherein each of said skimming means comprises;

a tube converging from a relatively wide inlet to a relatively narrow outlet, said inlet being positioned closely adjacent the layer of lighter materials, and suction means attached to the outlet of said converging tube.

* * * * *